US006550765B1

(12) United States Patent
Hyodo

(10) Patent No.: US 6,550,765 B1
(45) Date of Patent: Apr. 22, 2003

(54) GAME MACHINE

(75) Inventor: Kuniaki Hyodo, Tokyo (JP)

(73) Assignee: Aruze Corporation, Tokyo (JP)

( * ) Notice: Subject to any disclaimer, the term of this patent is extended or adjusted under 35 U.S.C. 154(b) by 89 days.

(21) Appl. No.: 09/707,899

(22) Filed: Nov. 8, 2000

(51) Int. Cl.[7] ..... A63F 7/02
(52) U.S. Cl. ..... 273/121 B
(58) Field of Search ..... 463/29, 16–22; 273/121 B; A63F 7/02

(56) References Cited

U.S. PATENT DOCUMENTS

| | | |
|---|---|---|
| 5,031,911 A | 7/1991 | Okada |
| 5,421,576 A | 6/1995 | Yamazaki et al. |

FOREIGN PATENT DOCUMENTS

| | | |
|---|---|---|
| JP | 11-342242 | 12/1999 |
| JP | 2000-135366 | 5/2000 |
| JP | 2000-167191 | 6/2000 |
| JP | 2000-185157 | 7/2000 |
| JP | 2000-202097 | 7/2000 |

OTHER PUBLICATIONS

Translation of JP 2000–167191 A, Jun. 2000.*

* cited by examiner

*Primary Examiner*—Michael O'Neill
(74) *Attorney, Agent, or Firm*—Leydig, Voit & Mayer, Ltd.

(57) ABSTRACT

A game machine precluding deceit by making it impossible to learn the renewal period of a counter used to produce a random number for determining a big hit. The game machine includes a liquid crystal display device and a controller, the liquid crystal display device providing a varying display in response to a startup command and displaying symbols including a special symbol shifting to a special game state when the varying display stops at a specified combination of the special symbols. The controller executes a game control process including control of the display by the liquid crystal display device. The controller includes counters that repeatedly add a fixed number at counting time intervals and are initialized at constant periods and extract, for use as a special determination-purpose random number, a sum of count values of two specified counters initialized at different periods when the startup command is issued, and determines if the game is shifted to the special playing state based on the random number.

8 Claims, 21 Drawing Sheets

FIG. 8 《Timing for extracting random number for determining big hit》

FIG. 16

| Type of counter | Count value renewal range |
|---|---|
| Big hit determination random number counter | 0 ~ 255 |
| Big hit symbol determination random number counter | 0 ~ 14 |
| Failure symbol determination random number counter | 0 ~ 14 |
| Production display determination random number counter | 0 ~ 139 |

FIG. 17

Big hit determination table

| Big hit determination | Big hit determination random number |
|---|---|
| Big hit | 7 |
| Failure | 0 ~ 6 , 0 ~ 255 |

FIG. 18

Big hit symbol determination table

| Big hit symbol determination random number | Big hit symbol |
|---|---|
| 0 | 1 −1 −1 |
| 1 | 2 −2 −2 |
| 2 | 3 −3 −3 |
| 3 | 4 −4 −4 |
| 4 | 5 −5 −5 |
| 5 | 6 −6 −6 |
| 6 | 7 −7 −7 |
| 7 | 8 −8 −8 |
| 8 | 9 −9 −9 |
| 9 | 10 −10 −10 |
| 10 | 11 −11 −11 |
| 11 | 12 −12 −12 |
| 12 | 13 −13 −13 |
| 13 | 14 −14 −14 |
| 14 | 15 −15 −15 |

FIG. 19

Stop symbol determination table

| Left, middle, and right symbol determination random number | Stop symbol |
|---|---|
| 0 | 1 |
| 1 | 2 |
| 2 | 3 |
| 3 | 4 |
| 4 | 5 |
| 5 | 6 |
| 6 | 7 |
| 7 | 8 |
| 8 | 9 |
| 9 | 10 |
| 10 | 11 |
| 11 | 12 |
| 12 | 13 |
| 13 | 14 |
| 14 | 15 |

FIG. 20

Production display determination table (for big hits)

| Production pattern | Production pattern determination random number |
|---|---|
| Production A | 0 ~ 24 |
| Production B | 25 ~ 64 |
| Production C | 65 ~ 130 |
| Production D | 131 ~ 139 |

FIG. 21

Production display determination table (for failures)

| Production pattern type | Production pattern determination random number |
|---|---|
| Production E | 0 ~ 64 |
| Production F | 65 ~ 110 |
| Production G | 111 ~ 139 |

GAME MACHINE

BACKGROUND OF THE INVENTION

1. Field of the Invention

This invention relates to game machines such as pachinko (pin-ball) game machines comprising a display device for displaying symbols necessary for playing games and a controller such as a microcomputer for controlling of a display.

2. Description of the Related Arts

For example, such a type of pachinko game machines is provided, as comprises a display device for displaying varying symbols when specified conditions are met, and a prize is given to a player when the varying display stops at a specified combination of symbols (a so-called big hit).

In such a game machine; the determination of a big hit or failure is made as follows: The count value of a counter is obtained adding a fixed number +1 repeatedly at specified counting time intervals and initialized (reset to zero) at constant periods, the count value is extracted at an appropriate timing, and it is determined whether or not the extracted count value falls within a specified range of a big hit. The timing of extracting the count value as a random number for determining the big hit is the timing at which a start command is issued for the start of the varying display by a startup win (entry of a game ball into a startup win hole, which will be described later).

While the above-described random number extraction process is carried out in the main circuit board in the game machine and every time the count value of the counter is renewed to the same value at constant periods, if a signal produced along with the renewal is issued outside, a present count value is easily known from outside. Therefore, the conventional count values can be used for deceit actions.

For example, there can be a deceit perpetrated in the following manner: A circuit board for a deceit purpose (a so-called "hang-on circuit board") is connected to the main circuit board to tap signals outputted from the main circuit board and to constantly monitor the startup win detection signals. When a startup win signal is detected, the timing of extracting a count value for use as a random number for determining a big hit is delayed for the deceit purpose, the count value is extracted at a time point that can result in a big hit determination, and the count value is sent to the main circuit board to force the big hit determination to occur.

There are other manners of deceit using the "hang-on circuit board": In one manner, a big hit is forced to occur by starting up a deceiving function using the "hang-on circuit board" according to a predetermined process including the connection of the hang-on circuit board to the main circuit board, and ejecting balls in a special manner. In another manner, the deceit function is started up by connecting a "hang-on circuit board" having wireless communication function to the main circuit board and by transmitting signals from a radio transmitter.

In another possible case, the game machine shop side may perpetrate the deceit, in which the deceit function is started up by wired or wireless remote control. In that case, the big hit is forcibly controlled not to occur so that the game shop side increases a profit by the deceit.

The object of the invention is to provide a game machine capable of preventing deceits by making it impossible to know easily from outside the renewal periods of the count value of the counter extracted as random numbers for determining big hits.

SUMMARY OF THE INVENTION

It is an object of the invention to provide a game machine comprising: a display device starting up a varying display in response to a specified startup command, the display device displaying symbols necessary for a game, the symbols including special symbols arranged so that the game state shifts to a special game state if the varying display stops at a specified state of combination of the special symbols; a controller executing a game control process including steps of controlling the varying display, the controller having a plurality of counters, count values of which are obtained from repeating additions of respective fixed numbers at respective specified counting time intervals and are initialized at respective constant periods, wherein a value calculated using the count values of two specified counters out of the plurality of counters, the respective constant periods of the two specified counters being different from each other, is extracted as a random number for a determination, when the startup command is issued, the determination being made whether or not the game state is to be shifted to the special game state on the basis of the random number.

With this invention, the calculated values using the count values of the two specified counters initialized at different periods when a varying display startup command is issued is extracted as a random number for making a special determination. Therefore, it does not happen that the same value as the random number for making a special determination such as a big hit determination is extracted at constant periods, and so it is difficult to know from outside the value that is extracted for use as the random number for making the special determination. This makes it possible to preclude the deceit perpetrated, for example, by connecting the "hang-on circuit board."

Another object of the invention is to provide a game machine in which the value calculated using the count values of the two specified counters is a sum of the count values of the two specified counters.

With this invention, a sum of the count values of the two specified counters is extracted as a random number, making the calculation easier.

Another object of the invention is to provideagame machine in which one of the two specified counters is a register for executing rewriting actions at specified rewriting time intervals. This register is generally called the refreshment register (R-register). The rewriting actions carried out with this register are indispensable for retaining data in dynamic type memories (DRAMs). The DRAM is a kind of memory means. This rewriting action is generally called the "refreshment operation."

With this invention, while the above-described register is used for one of the two specified counters, since a DRAM accompanies an R-register, a new counter is unnecessary when a DRAM is used as memory means, making it economical.

Another object of the invention is to provideagame machine in which the controller executes the game control process every time an interruption signal is generated at specified interrupting time intervals, and one of the two specified counters is constituted to repeat the addition of the fixed number at the specified counting time intervals to obtain the count value which is initialized at the constant periods, after the execution of the game control process and until a next interruption signal is generated.

With this invention, one of the two specified counters is a counter that repeats adding a fixed number at the specified counting time intervals after the execution of the game control process and until the next interruption signal is produced and the counter is initialized at the constant periods. Therefore, the remaining time during which the occurrence of an interruption signal is waited for can be utilized effectively.

It is an object of the invention to provide a method of playing a game comprising the steps of; starting up a varying display in response to a specified startup command; displaying symbols necessary for the game, the symbols including special symbols arranged so that the game state shifts to a special game state if the varying display stops at a specified state of combination of the special symbols; and executing a game control process including the control of the varying display, the control process including, a first addition step of repeating a first addition of a first fixed number at first specified counting time intervals to obtain a first count value and storing the first count value, a first initializing step of initializing the first count value at first constant periods, a second addition step of repeating a second addition of a second fixed number at second specified counting time intervals to obtain a second count value and storing the second count value, a second initializing step of initializing the second count value at second constant periods different from the first constant periods, an extracting step of extracting a value calculated using the first and second count values as a special determination random number when the startup command is issued, and a determining step of determining if the game is to be shifted to the special game state on the basis of the special determination random number.

Another object of the invention is to provide a method of playing a game in which the value calculated using the first and second count values is a sum of the first and second count values.

Another object of the invention is to provide a method of playing a game comprising a refreshing step of generating refreshment pulses for executing rewriting actions at specified refreshing time intervals, wherein the addition step of repeating at least either one of the first and the second addition is performed at every generation of the refreshment pulse.

Another object of the invention is to provide a method of playing a game comprising a step of generating interruption signals at specified interrupting time intervals, wherein the game control process is performed every time the interruption signal is generated, and at least either one of the first and second addition is repeated at the specified counting time intervals after the game control process is performed until a next interruption signal is generated.

BRIEF DESCRIPTION OF DRAWINGS

FIG. 16 is a table of a renewal range of count values in various random number counters.

FIG. 17 is a table of a big hit determination.

FIG. 18 is a table of a big hit symbol determination.

FIG. 19 is a table of a stop symbol determination.

FIG. 20 is a table of a big hit production display determination.

FIG. 21 is a table of a failure production display determination.

The basic Japanese Patent Application No. Hei-11-204733 filed on Jul. 19, 1999 is hereby incorporated in its entirety by reference into the present application.

The present invention will become more fully understood from the detailed description given hereinbelow. However, the detailed description and the specific embodiment are illustrated of desired embodiments of the present invention and are described only for the purpose of explanation. various changes and modifications will be apparent to those ordinarily skilled in the art on the basis of the detailed description.

The applicant has no intention to give to the public any of the disclosed embodiments. Among disclosed changes and modifications, those that may not literally fall within the scope of the patent claims constitute, therefore, a part of the present invention in the sense of the doctrine of equivalents.

DESCRIPTION OF PREFERRED EMBODIMENTS

A pachinko game machine as an embodiment of the invention will be described below.

Figure 1:
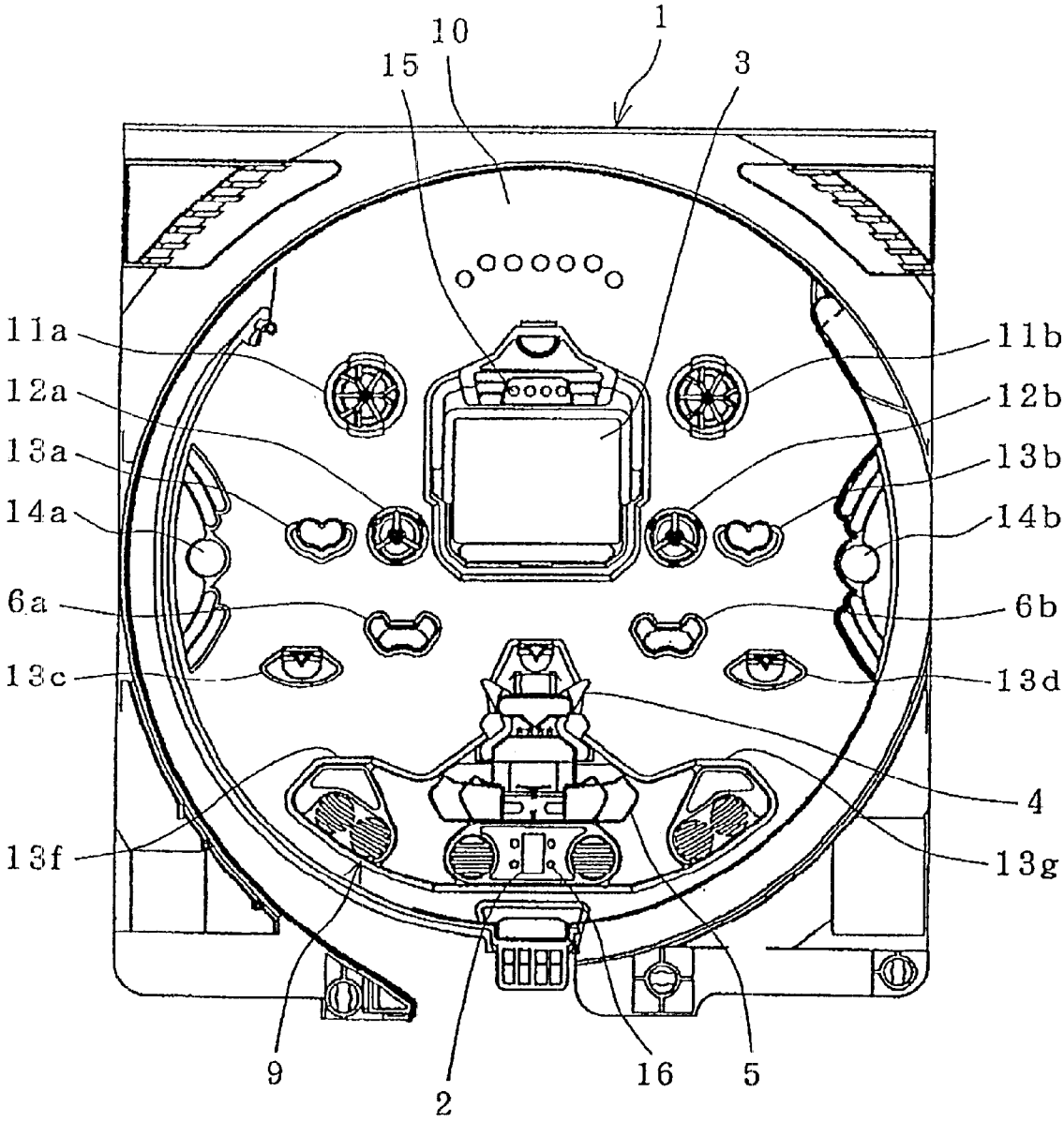
FIG. 1 is a front view of the game console of a pachinko game machine as an embodiment of the invention.

FIG. 1 is a front view of the game console 10 of a pachinko game machine 1 as an embodiment of the invention. A liquid crystal display device 3 for showing symbols necessary for playing games is disposed in the central area of the game console 10. The liquid crystal display device 3 shows three rows of rotating reels of a slot machine in simulated, varying a plurality of symbols represented by images. The varying symbols are called the "special symbols." The special symbols are arranged so that the game state shifts to a special one that is favorable for the player when their varying display stops at a specified state of combination of symbols (for example "7-7-7" referred to as a "big hit" stop state). In addition to the special symbols, production (dramatic) displays constituted with various symbols are shown on the liquid crystal display device 3. Besides the liquid crystal display device of this embodiment, other electric display devices may be used; such as a display constituted with a large number of LEDs (light-emitting diodes), CRT(a cathode-ray tube), a plasma display, an electroluminescence display, etc.

A startup win hole (so-called start hole) 4 is provided below the liquid crystal display device 3 and is arranged so that the symbol on the liquid crystal display device 3 starts to vary when a game ball enters the hole. In other words, a startup command to start varying display of the special symbols is issued by the winning entry of a game ball into the startup win hole 4. The startup win hole 4 comprises a variable win ball device 9 can be changed between a first state in which the game ball is less likely to enter and a second state in which the game ball is more likely to enter, and is arranged so that a specified number of (for example five) prize balls are dispensed when a game ball enters the hole 4. Incidentally, since the startup win hole 4 reserves a space for accommodating about one winning game ball even in the first state, a winning entry of a game ball is possible even in the first state.

Four symbol variation memory lamps 15 are provided above the liquid crystal display device 3 to store the number of times, up to four, of entries of the game balls into the startup win hole 4 while the symbols are being variation-displayed on the liquid crystal display device 3, and to notify the player of the possible number of times by which the liquid crystal display device 3 at that moment can make variation displays. An entry of a ball after the stored number of winning entries reaching four, namely a fifth entry or an entry after that, is ineffective as a startup condition for the variation display on the liquid crystal display device 3.

A big win device (so-called "attacker") 5 changeable between a closed state that is unfavorable for the player and an open state that is favorable for the player is provided below the startup win hole 4. The big win device 5 comprises a variable win ball device 9 with opening-closing doors to be opened to be favorable for the player for a specified period of time when the liquid crystal display device 3 stops the variation display of symbols and displays a specific combination of symbols that brings about a "big hit." It is arranged so that when a game ball enters the big win device 5, a specified number of (for example 15) prize balls are dispensed. The above-mentioned special game state is the one with the big win device 5 being in the open state and with the variation time of symbols on the liquid crystal display device 3 shortened so as to increase the number of winning entries into the startup win hole 4.

A seven-segment LED display device 2 is provided in the lower part of the game console 10. The device 2 is arranged to start variation display on the device 2 when the game balls pass through LED actuation gates 6*a* and 6*b* provided right and left-below the liquid crystal display device 3. When the image shown on the LED display device 2 stops at a predetermined specific state, the startup win hole 4 is changed to the above-mentioned second state that is favorable for the player.

Four LED actuated memory lamps 16 are provided around the LED display device 2 to store every passage, up to four times, of the game ball through the LED actuation gates 6*a* and 6*b*, and to notify the player of the number of times of display variations that can be made on the LED display device 2 at that moment. The fifth or later passage of the game ball through the LED actuation gates 6*a* or 6*b* is not counted and becomes ineffective.

Windmills 11*a* and 11*b* each with a lamp having a light emitting section, ordinary windmills 12*a* and 12*b*, general win holes 13*a*, 13*b*, 13*c*, 13*d*, 13*f*, and 13*g* for dispensing 15 prize balls to the player every time of win, and console side lamps 14*a* and 14*b* are provided on the game console 10.

The LED display device 2, the startup win hole 4, the big win device 5, and the general win holes 13*f*, 13*g* constitute a single-unit, variable win ball device 9, disposed on the game console.

Figure 2:
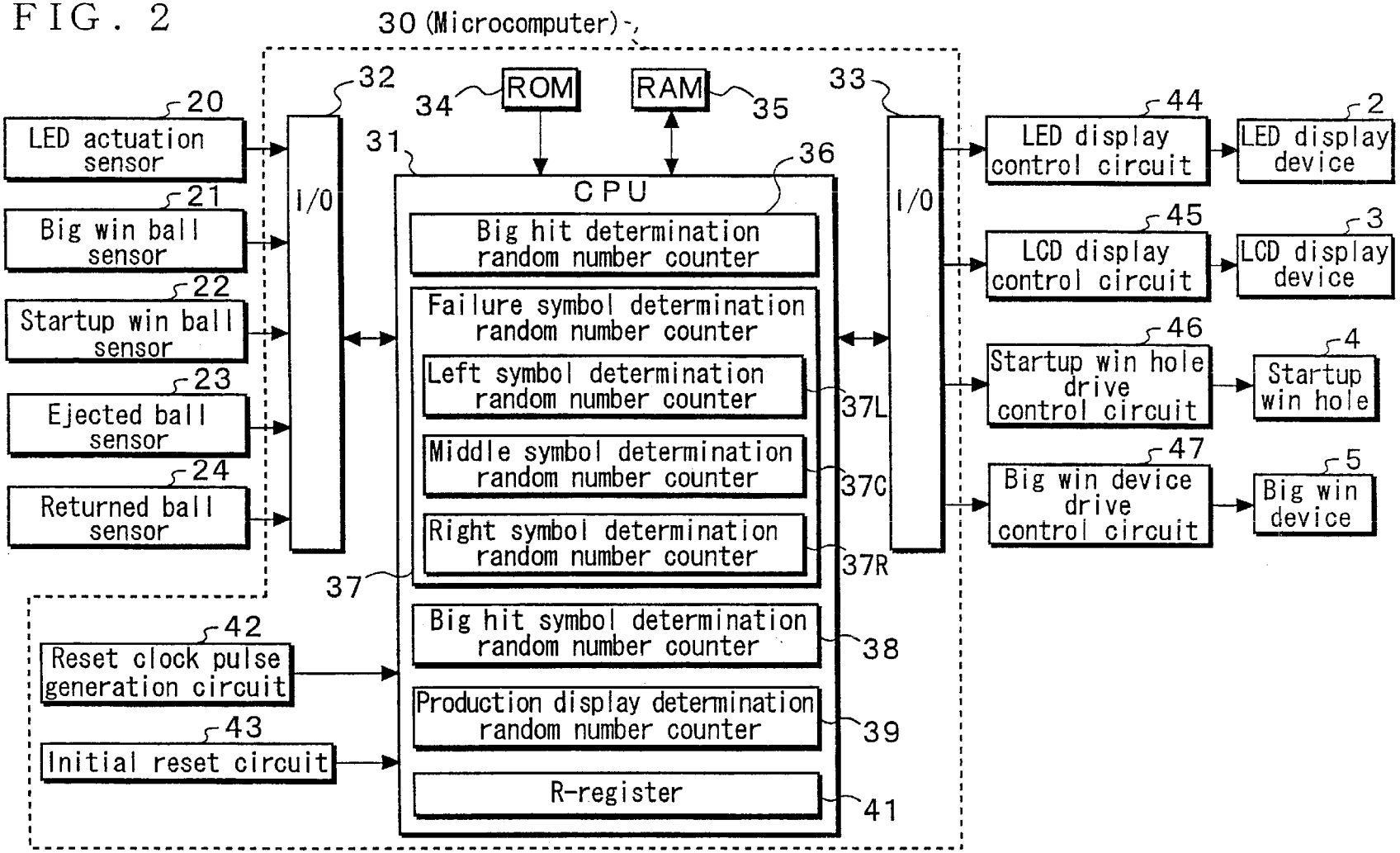
FIG. 2 is a block diagram of an electric circuit section of the pachinko game machine.

FIG. 2 is a block diagram of an electric circuit section provided as a controller in the pachinko game machine shown in FIG. 1.

As shown in the figure, the pachinko game machine of this embodiment comprises; an LED actuation sensor 20 for detecting the game balls passing through the LED actuation gates 6*a* and 6*b*, a big win ball sensor 21 for detecting the balls entering the big win device 5, a startup win ball sensor 22 for detecting the balls entering the startup win hole 4, an ejected ball sensor 23 for detecting the balls ejected from a ball ejecting device (not shown), and a returned ball sensor 24 for detecting the game balls that have been returned without reaching the console surface.

Operation of the pachinko game machine is controlled with a microcomputer 30 which comprises; a central processing unit (CPU) 31, an input-output (I-O) ports 32 and 33 to be interfaces between the sensor and a drive circuit to be described later, ROM 34, as a read-only memory device, and RAM 35, as a readable and writable memory device. A dynamic type memory (DRAM) is used as the RAM 35.

The microcomputer 30 further comprises; an initial reset circuit 43 for issuing an initial reset signal for executing the process of initializing the electric circuit including the CPU 31 when the power is supplied, and a resetting clock pulse generating circuit 42 for generating reset signals ("interruption signals") for executing periodically (for example at 2 ms intervals) an overall game control process program. In the CPU 31 are provided; an R-register 41 for generating refreshment pulses necessary for the rewriting operation (refreshment operation) executed at specified rewriting time (for example 2 ms) intervals for retaining memory of the RAM 35, a big hit determining random number counter 36 which repeats adding a fixed number at specified counting time intervals (in this case at every interruption signal generated), is initialized (reset to zero) at constant periods, and extracts special determination random numbers (concretely "big hit determining random numbers") necessary for determining game states to be special ones, a failure symbol determining random number counter 37 for extracting failure symbol determining random numbers, a big hit symbol determining random number counter 38 for extracting big hit symbol determining random numbers, and a production display determining random number counter 39 for extracting production display determining random numbers.

Signals detected respectively with the LED actuation sensor 20, the big win ball sensor 21, the startup win ball sensor 22, the ejected ball sensor 23, and the returned ball sensor 24 are inputted through the I-O port 32 to the CPU 31. According to input signals from the respective sensors, the CPU 31 sends specified signals through the I-O port 33 to an LED display device control circuit 44, a liquid crystal display (LCD) device control circuit 45, a startup win hole drive control circuit 46, and a big win device drive control circuit 47. The LED display device 2, liquid crystal display device 3, startup win hole 4, and big win device 5 are respectively drive-controlled with output signals from the LED display device control circuit 44, liquid crystal display device control circuit 45, startup win hole drive control circuit 46, and big win device drive control circuit 47.

When a game is played, the LED actuation sensor 20 detects balls passing through the LED actuation gates 6*a* and 6*b*, and outputs detection signals. The microcomputer 30 determines wins and failures according to the detection signals. According to the determined results, display signals are outputted from the LED display device control circuit 44 to the LED display device 2. The LED display device 2 performs displaying action according to the display signals.

When the startup win ball sensor 22 detects balls entering the startup win hole 4 and outputs detection signals, the microcomputer 30 makes various determinations according to the signals about the games on the liquid crystal display device 3, and sends a variation display startup command on the basis of the determination results to the liquid crystal display device control circuit 45. The various determinations about the games on the liquid crystal display device 3 include the determination of big hit or failure, how to stop the special symbol in case of a big hit, how to stop the special symbol in case of a failure, and the determination about production display. Details will be described in reference to flowcharts, FIGS. 4 to 6.

Incidentally, the data for the various symbols displayed on the liquid crystal display device 3 are stored in a ROM 34 in the microcomputer 30. The liquid crystal display device control circuit 45 reads the data of the symbols to be displayed from the ROM 34 according to the instruction of the CPU 31 and causes the liquid crystal display device 3 to display the symbols. It may also be arranged so that the liquid crystal display device control circuit 45 comprises its own memory device to store data for the various symbols.

Figure 3:
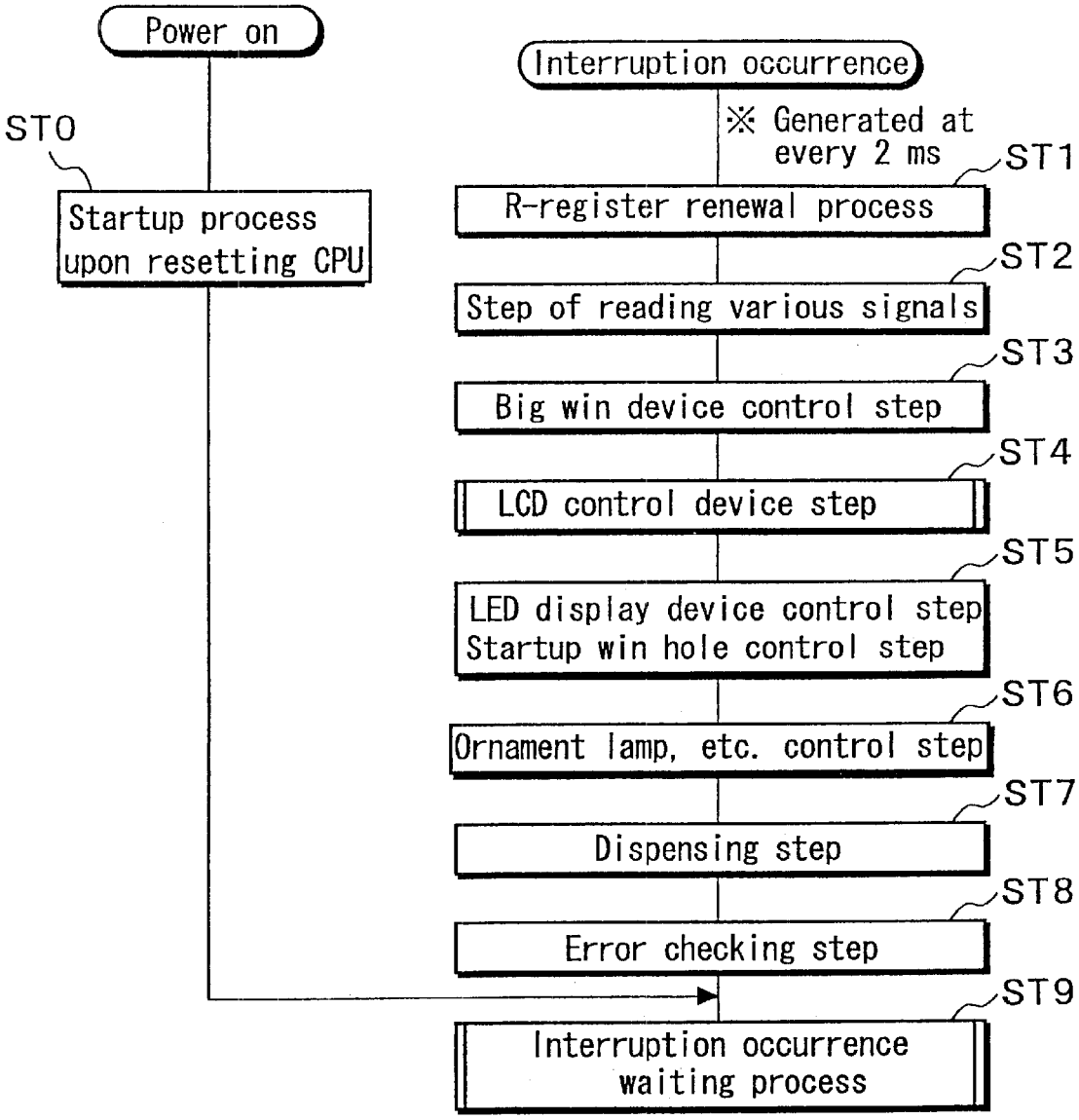
FIG. 3 is a flowchart of a game control process related to the entire game machine.

FIG. 3 is a flowchart of a control process related to an entire game machine and performed in the above-mentioned electric circuit.

As described above, the CPU 31 executes a series of game control process program upon occurrence of interruption by reset signals (hereafter referred to as "interruption signals") taken from the reset clock pulse generation circuit 42 (FIG. 2) every 2 ms. If an interruption occurs, the game control process program is executed from the beginning (ST1) to the end (ST8) of the program and during the period up till the next interruption, a process of waiting for an interruption to occur is executed (ST9), which will be described below in detail.

When an interruption occurs, a process of the R-register renewal is carried out first (ST1). In the R-register renewal process, addition of +1 for a fixed number to the count value, for a second count value, of the R-register 41 is repeated every time (every 2 ms) a refreshment pulse is produced. The count value is reset to zero when a refreshment pulse is generated after the count value has reached "127" predetermined as an upper limit. The count value of the R-register 41 is stored in the RAM 35 at every renewal and used as an indeterminate value which will be described later.

Next, the following steps are performed: a step (ST2) of reading input signals from various sensors such as the LED actuation sensor 20 and the startup win ball sensor 22, a control step (ST3) related to the big win device 5, such as actions of opening and closing the door of the big win device 5, a control step (ST4) related to the game on the liquid crystal display device 3, a control step (ST5) including the variation display and stop display on the LED display device 2 and control of switching actions from the first to second state or vice versa of the startup win hole 4, a control step (ST6) for the ornament lamps such as those of the windmills 11*a*, 11*b*, console side lamps 14*a* and 14*b*, a step (ST7) of dispensing win balls (pachinko balls), and an error check step (ST8) of checking the occurrence of error signals in the various devices.

After the end of the step ST8, during the lapse of 2 ms from the occurrence of the interruption, a process of waiting for an occurrence of an interruption is executed (ST9). In the interruption waiting process, an endless loop process of a cycle period of 0.1 ms is performed until 2 ms lapse after the occurrence of the previous interruption.

When 2 ms lapse from the occurrence of the previous interruption, the interruption waiting process is finished, a resetting clock pulse generating circuit 42 is caused to generate an interruption signal, and again the game control process program is executed from the beginning (ST1). The entire game machine is controlled by repeating such a game control process program.

Incidentally, in case the power source is turned on, an initial resetting signal is inputted from the initial reset circuit 43 into the CPU 31, and after finishing the initial process (ST0) for the electric circuit including the CPU 31, the process moves on to the interruption waiting process, ST9.

Figure 4:
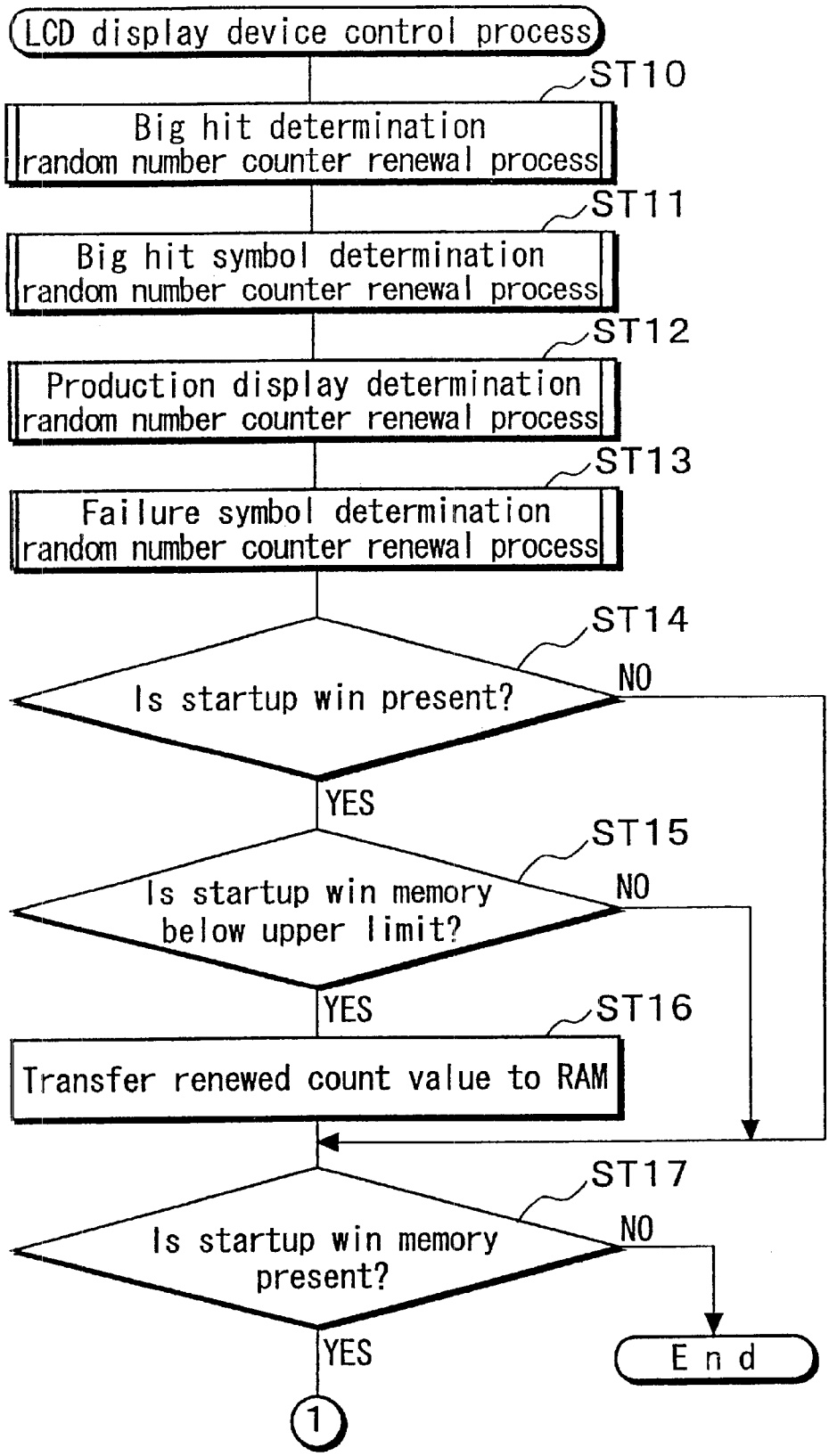
FIG. 4 is a flowchart of a game control process related to a game played with a liquid crystal display device.
Figure 5:
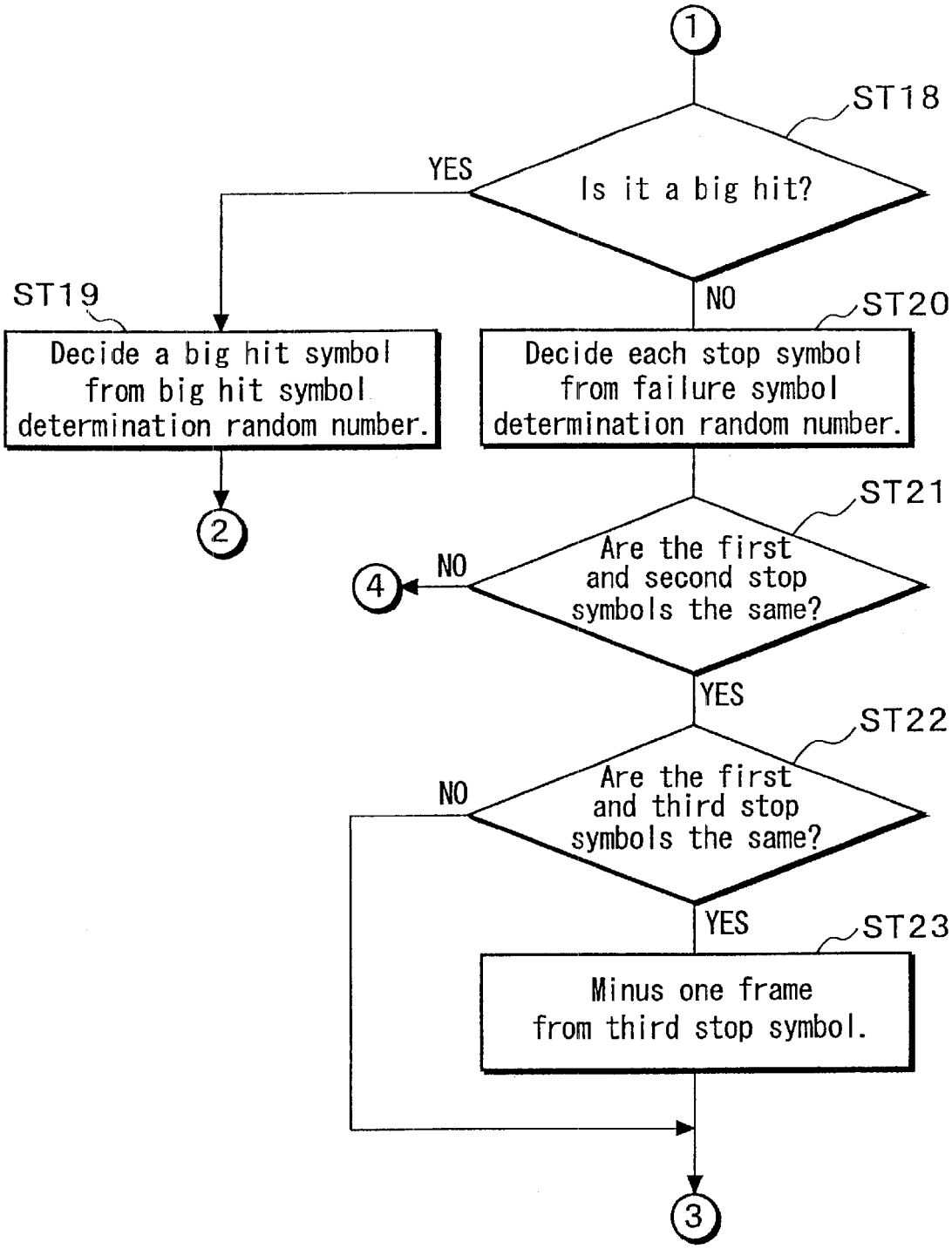
FIG. 5 is a flowchart continued from FIG. 4.
Figure 6:
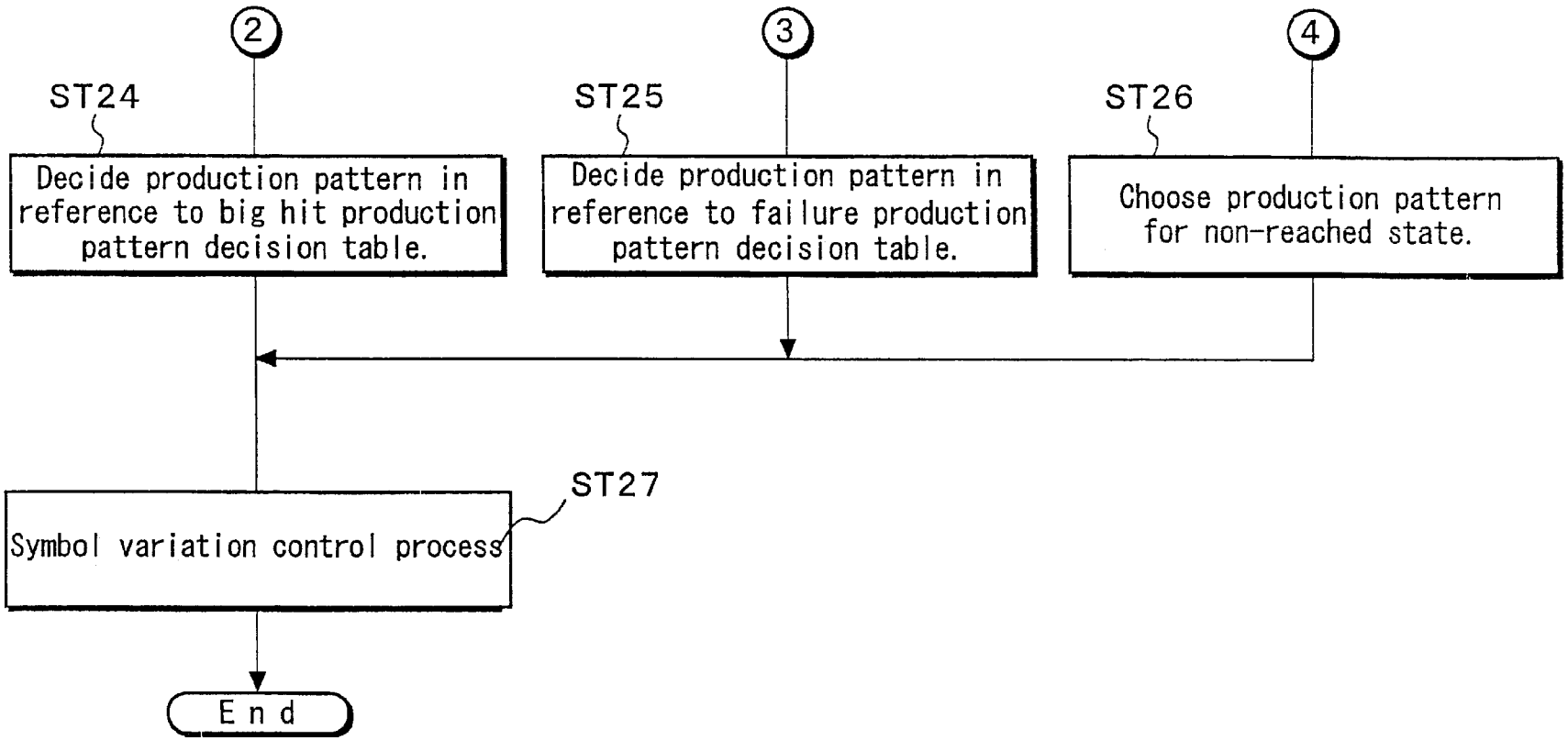
FIG. 6 is a flowchart continued from FIG. 5.

The flowcharts in FIGS. 4 to 6 show the sequence of the control process (liquid crystal display device control process) in the above-mentioned step ST4 for the games played on the liquid crystal display device 3.

In this liquid crystal display device control process, every 2 ms, renewal processes (ST10 to ST13) are performed for the big hit determination random number counter 36, big hit symbol a determination random number counter 38, production display determination random number counter 39, and failure symbol determination random number counter 37. The renewal processes will be described below.

After the renewal processes for the random number counters, the CPU 31 determines if the input signals from the startup win sensor 22 are present as a result of the entry of game balls into the startup win hole 4 (ST14). If the signals are present, the process goes on to determine if the number of the startup wins stored is less than an upper limit (for example 4) (ST15). If it is determined to be less than the upper limit, count values of the counters 36 to 39 renewal-processed in the ST10 to ST13 are extracted as the random numbers for the big hit determination, big hit symbol determination, production display determination, and failure symbol determination, and sends them to the RAM 35 to be stored (ST16). Incidentally, if the determinations in ST14 and ST15 are "NO," the random number values after the renewal processes are not sent to the RAM 35.

Then the CPU 31 determines if the number of the startup wins stored is present (ST17) and, if not present, finishes the liquid crystal display device control process.

If the number is present on the other hand, the process moves on to the next step (ST18) shown in FIG. 5. Here, the CPU 31 determines if it is a big hit or failure (ST18) on the basis of a table of random numbers for determining big hits stored in the RAM 35 and in reference to a big hit determination table (FIG. 17) stored in the ROM 34.

If it is determined to be a big hit with the random number of "7," the big hit symbol determination table (FIG. 18) stored in the ROM 34 is referred to, and a big hit stop state is determined (ST19) on the basis of the big hit symbol determination random number stored in the RAM 35. In ST19, if the big hit symbol determination random number is "0" for example, "1-1-1" is determined as the big hit stop state to be displayed on the liquid crystal display device 3.

When the big hit stop state is determined, then the type of production display to be shown is determined (ST24 in FIG. 6). The production display is shown with symbols that are different from the variation display of the special symbols. In this embodiment, as shown in FIGS. 20 and 21, four patterns of productions A, B, C, and D are set for the big hit displays, and three patterns of productions E, F, and G are set for the failure displays. In determining the production displays, the CPU 31 refers to the big hit production display determination table (FIG. 20) stored in the ROM 34 and determines a production display to be shown on the basis of the production display random number stored in the RAM 35.

If the step ST18 determines a failure, the CPU 31 refers to the stop symbol determination table (FIG. 19) stored in the ROM 34, and determines a special symbol to be stop-displayed (ST20) on the basis of failure symbol determination random numbers; they are random numbers stored in the RAM 35 for determining the left symbol, middle symbol, and right symbol.

Then the CPU 31 determines from among the determined stop symbols if the symbol to be stopped first (the first stop symbol) is the same as the symbol to be stopped next (the second stop symbol) (ST21). If it is determined to be the same, a next determination is made if the first stop symbol is the same as the symbol to be stopped third (the third stop symbol) (ST22). If it is determined to be the same, the third stop symbol is shifted by one frame to arrange so that the three stop symbols do not become identical.

When the result is failure as described above and the first stop symbol is the same as the second stop symbol (in the so-called "reached state"), the process continues to ST25 shown in FIG. 6 to determine a production display to be shown. In this ST25 for determining the production display, the CPU 31 refers to the production display determining table (FIG. 21) for failures stored in the ROM 34, and determines a production display to be shown on the basis of the production display determination random number stored in the RAM 35.

If the ST21 above determines that the first stop symbol is not the same as the second stop symbol, namely not in the reached state, the CPU 31 chooses a production pattern for a non-reached state stored in the ROM34 (ST26 in FIG. 6).

When the stop symbol and the production display are determined as described above, the CPU 31 on the basis of the determination performs symbol variation control process including the variation display on the liquid crystal display device 3 with the liquid crystal display device control circuit 45 (ST27), and ends the process according to a predetermined ending procedure.

Figure 7:
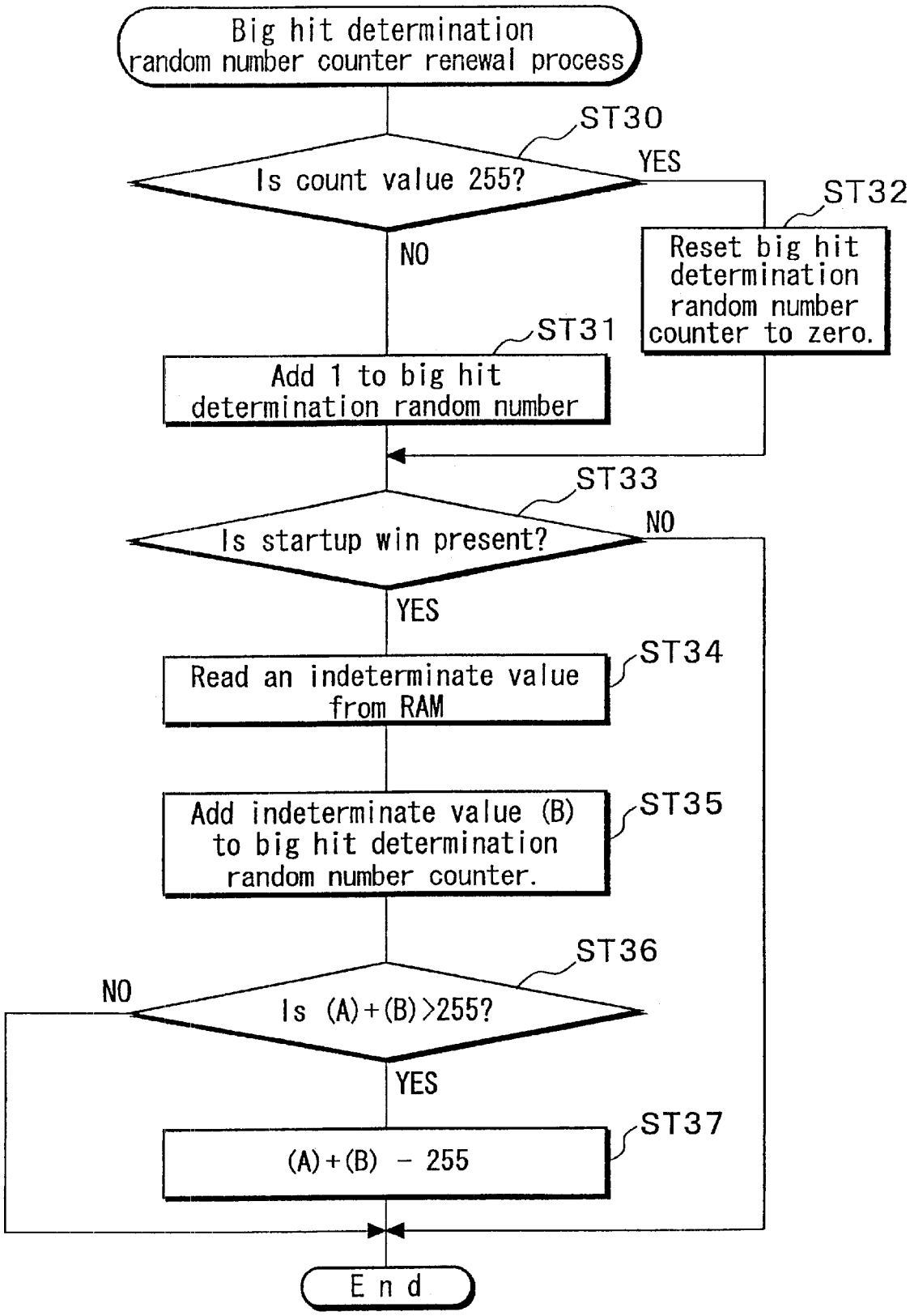
FIG. 7 is a flowchart of a renewal process with a random number counter for determining big hits.

Next, the flowchart in FIG. 7 shows the renewal process with the big hit determination random number counter 36 performed in ST10 shown in FIG. 4.

In this renewal process, addition of +1 for a fixed number to the count value for a first count value is performed every time within the range of 0 to 255 shown in FIG. 16. Therefore, first it is determined if the count value is 225 (ST30). If the count value is not 225, it is renewed to a value obtained by adding with +1 (ST31). On the other hand, if the previously renewed value is 225, the count value is reset to zero (ST32).

Next, the CPU 31 determines the presence of stored data of a startup win (ST33) and, if present, reads an indeterminate value (a count value renewed with the R-register 41) stored in the RAM 35 (ST34) and adds the indeterminate value to the count value renewed in the steps from ST30 to ST32 above, and uses the resultant value to further renew the count value of the big hit determination random number counter 36. If the count value after the addition of the indeterminate value exceeds 225, the value 225 is subtracted from the count value (ST37).

Here, while the upper limit for resetting the count value of the R-register is 127, that for the big hit determination random number counter 36 is 225. In other words, the period for initializing the count value (hereafter referred to as "the renewal period") of the R-register 41 extracted as the indeterminate value is different from that of the big hit determination random number counter 36. Therefore, since the indeterminate value is added to the count value of the big hit determination random number counter 36 to renew it, the count value after the addition does not become the same value at constant periods. This means that the renewed value of the big hit determination random number counter 36 is difficult to predict from outside. Namely, deceit acts by connecting the "hang-on circuit board" can be precluded.

Figure 8:
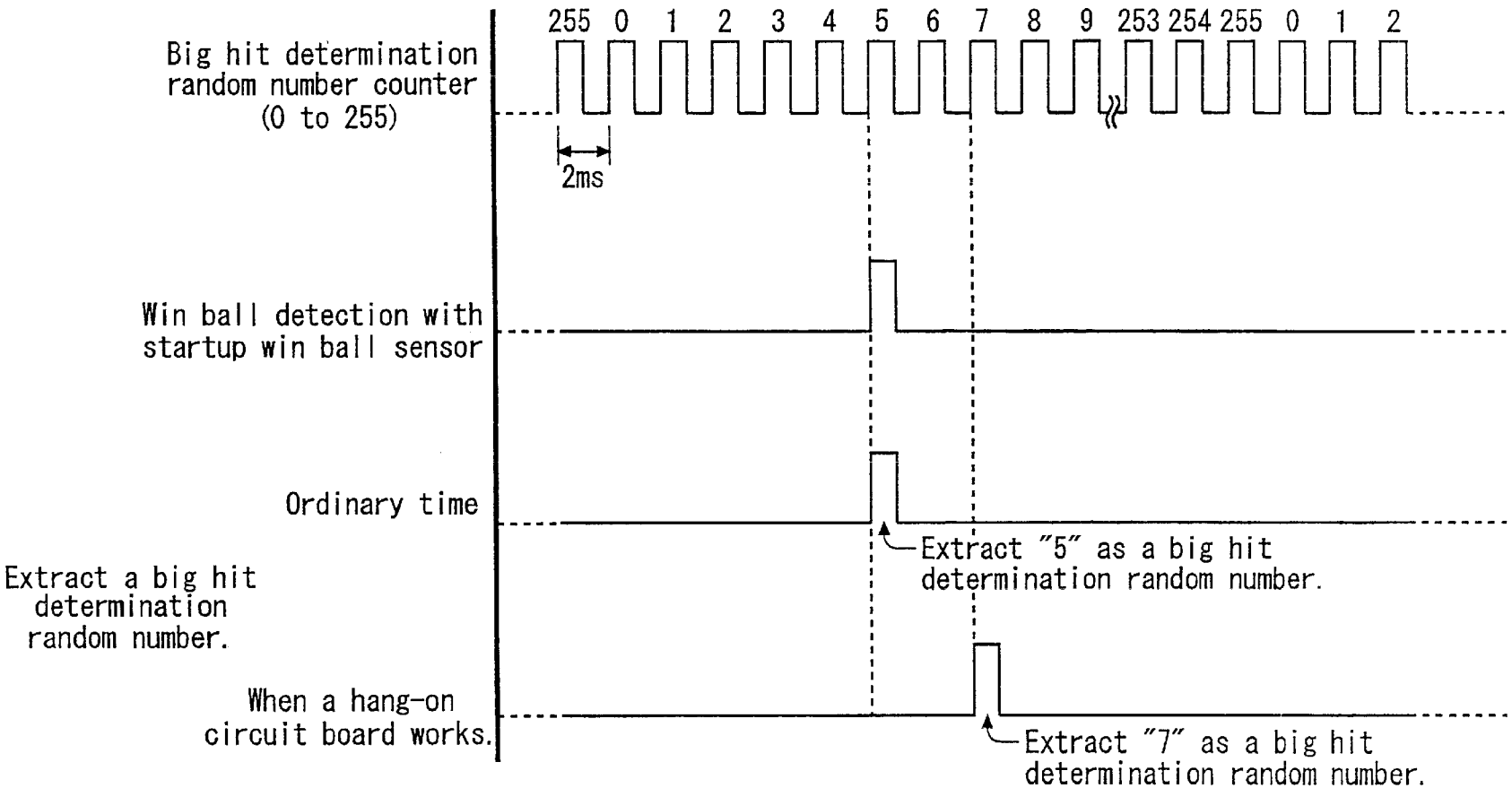
FIG. 8 is a time chart of random number extraction timing for determining big hits.
Figure 9:
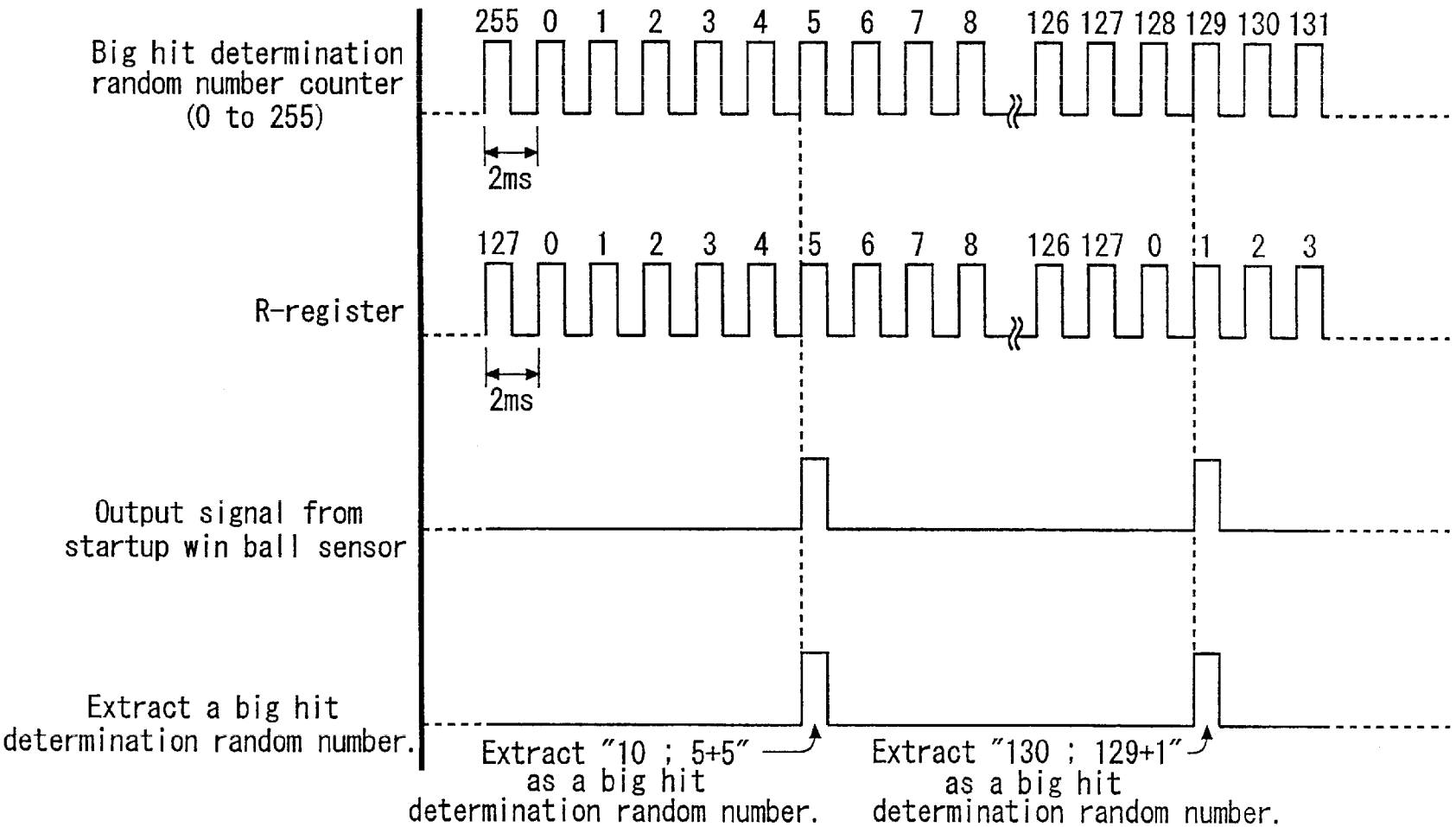
FIG. 9 is a time chart of random number extraction timing for determining big hits in the case an R-register is used as an indeterminate number generating means.

Next, FIGS. 8 and 9 show the extraction timing of the big hit determination random number.

FIG. 8 shows the conventional method of extracting the big hit determination random number. When a win ball is detected with the startup win ball sensor 22, and a startup command for the variation display on the liquid crystal display 3 is issued, the count value "5" of the big hit determination random number counter 36 at that time is extracted as the big hit determination random number.

According to the conventional extraction method, in case a "hang-on circuit board" for deceit is attached and an illegal act is perpetrated, "7" for causing a big hit determination can be extracted by delaying the timing of extracting the big hit determination random number for two counts (4 ms) of the big hit determination random number counter 36 as shown in FIG. 8. The reason for the above is as follows: As the big hit determination random number counter 36 performs cyclic actions in which the same count value occurs at constant intervals, if a count value is "5," a count value after two counts from "5" is easily known to be "7."

In contrast to the above, FIG. 9 shows a method of extracting the big hit determination random number with a game machine of this invention. When a win ball is detected with the startup win ball sensor 22 and a startup command for the variation display on the liquid crystal display 3 is issued, since the count value of the big hit determination random number counter 36 is "5" and the count value of the R-register 41 is "5," the sum for a calculated value "10" of the two count values is extracted as the big hit determination random number.

The sum of the value obtained by multiplying the count value of the counter 36 by 2, for example, and the count value of the R-register 41 may be extracted as the big hit determination random number. The count value of the R-register 41 may be subtracted from the count value of the counter 36 and the absolute value may be extracted for the big hit determination random number with the counting time intervals of the counter 36 different from the rewriting time intervals of the R-register 41.

As described before, since the big hit determination random number counter 36 and the R-register 41 are renewed at different periods, it does not occur that the same value is extracted as the big hit determination random number at constant periods.

In the above description the fixed number (+1) added to the count value of the counter 36 is equal to the fixed number (+1) added to the count value of the R-register 41, but the fixed number added to the count value of the counter 36 may be different from the fixed number added to the count value of the R-register 41.

Incidentally, in place of the R-register 41 as the indeterminate value generating means for use in the renewal step of the big hit determination random number counter 36 described with the flowchart of FIG. 7, a separate random number counter may be provided to use a count value renewed with the separate random number counter as an indeterminate value.

Figure 10:
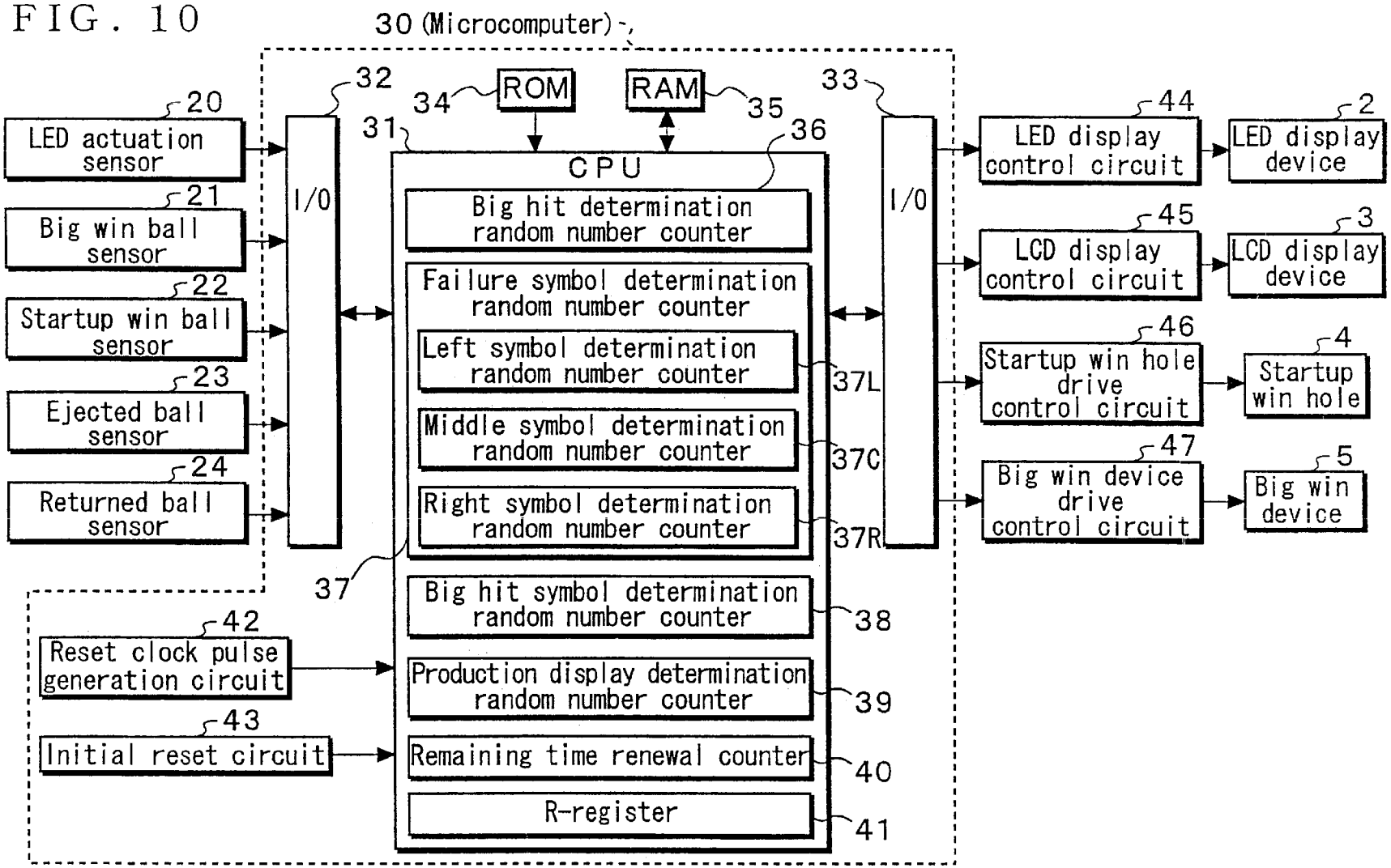
FIG. 10 is a block diagram of another example of an electric circuit.

As an example of the above case, a remaining time renewal counter 40 is provided in the CPU 31 (FIG. 10), which, during the step of waiting for an occurrence of an interruption signal, repeats addition of +1 for a fixed number every time an endless loop is cycled (every 0.1 ms in this embodiment) and resets itself to zero when the count value reaches the upper limit of the renewal range. The renewal range is between 0 and 127.

Figure 11:
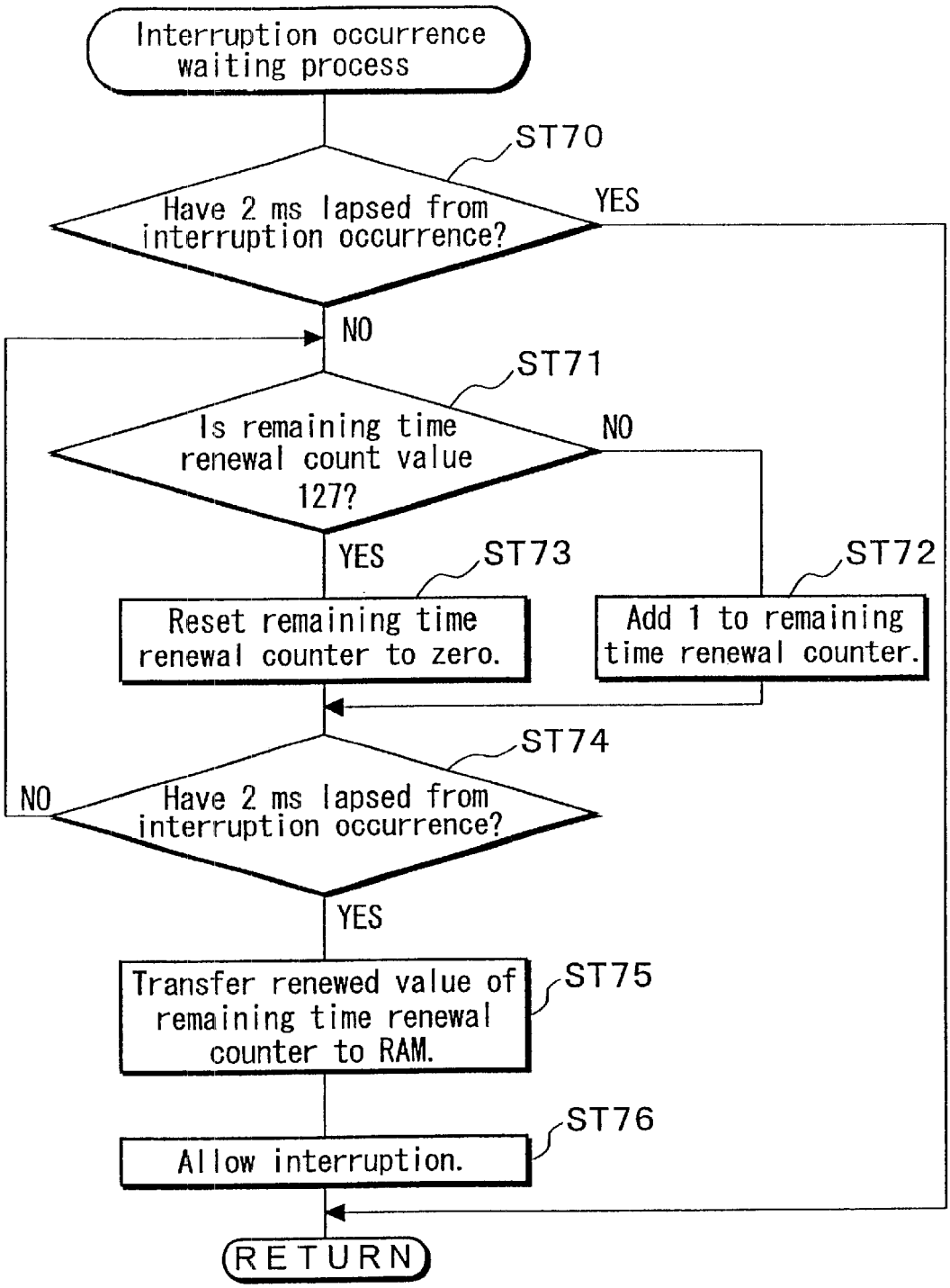
FIG. 11 is a flowchart of a renewal process performed with a remaining time renewal counter.

The flowchart in FIG. 11 shows the case of performing a renewal step with the remaining time renewal counter 40 during the step ST9 in FIG. 3 of waiting for an occurrence of an interruption signal.

First, it is determined if the time of 2 ms has lapsed from the interruption (ST70). If time is left before the lapse of 2 ms, it is determined if the count value of the remaining time renewal not to have reached 127, the count value of the remaining time renewal counter 40 is renewed by adding +1 for a fixed number to the count value (ST72).

When the count value is determined to have reached 127 in the step ST71, the count value of the remaining time renewal counter 40 is reset to zero (ST73). And it is determined again if the time of 2 ms has lapsed from the occurrence of the interruption (ST74). If time is left before the occurrence of interruption, the step from ST71 is repeated again.

Figure 12:
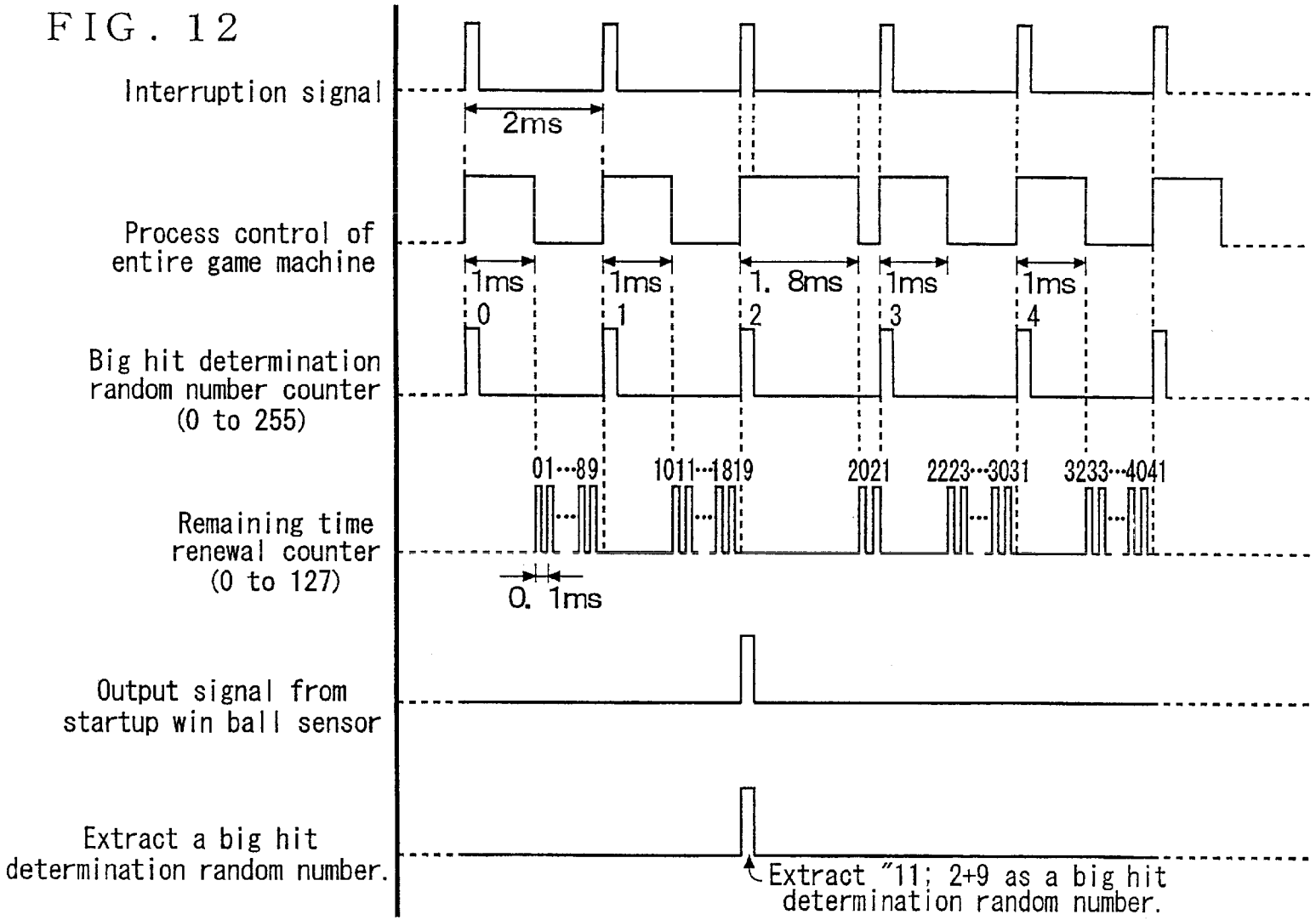
FIG. 12 is a timing chart of extracting a random number for determining a big hit when a remaining time renewal counter is used as an indeterminate number generating means.

FIG. 12 shows a time chart of timing of extracting big hit determination random numbers when using the count value of the remaining time renewal counter 40 as the indeterminate value.

As shown in the figure, if the time required for executing the game control step of the entire game machine (from ST1 to ST7 in FIG. 3) is 1 ms for example, since the remaining time until the occurrence of an interruption is 1 ms and the renewal step with the remaining time renewal counter 40 is performed every 0.1 ms, the renewal step is repeated ten times. And if the time required for executing the game control step of the entire game machine is 1.8 ms, since the remaining time until the occurrence of interruption is 0.2 ms, the renewal step can be repeated two times.

When 2 ms lapse from the occurrence of an interruption, the renewal step with the remaining time renewal counter 40 is stopped and the count value of the remaining time renewal counter 40 at this time point is transferred as the indeterminate value to the RAM 35 and stored (ST75). And the interruption is allowed to occur (ST76).

In case the count value with the remaining time renewal counter 40 is used as the indeterminate value, the big hit determination random number to be extracted when a win ball is detected with the startup win ball sensor 22 and a startup command for the variation display on the liquid crystal display 3 is issued is, as described above, the sum of the count value with the remaining time renewal counter 40 and the count value of the big hit determination random number counter 36. For example, as shown in FIG. 12, if the count value of the big hit determination random number counter 36 when a win ball is detected with the startup win ball sensor 22 is "2," since the count value of the remaining time renewal counter 40 stored in the RAM 35 at that time is "9," the sum "11" of both of the count values is extracted as the big hit determination random number.

Since the big hit determination random number counter 36 and the remaining time renewal counter 40 are mutually different in the count renewal period like the case of using the R-register 41 as the indeterminate value generating means, it does not happen that the same value is extracted at constant periods as the big hit determination random number.

Figure 13:
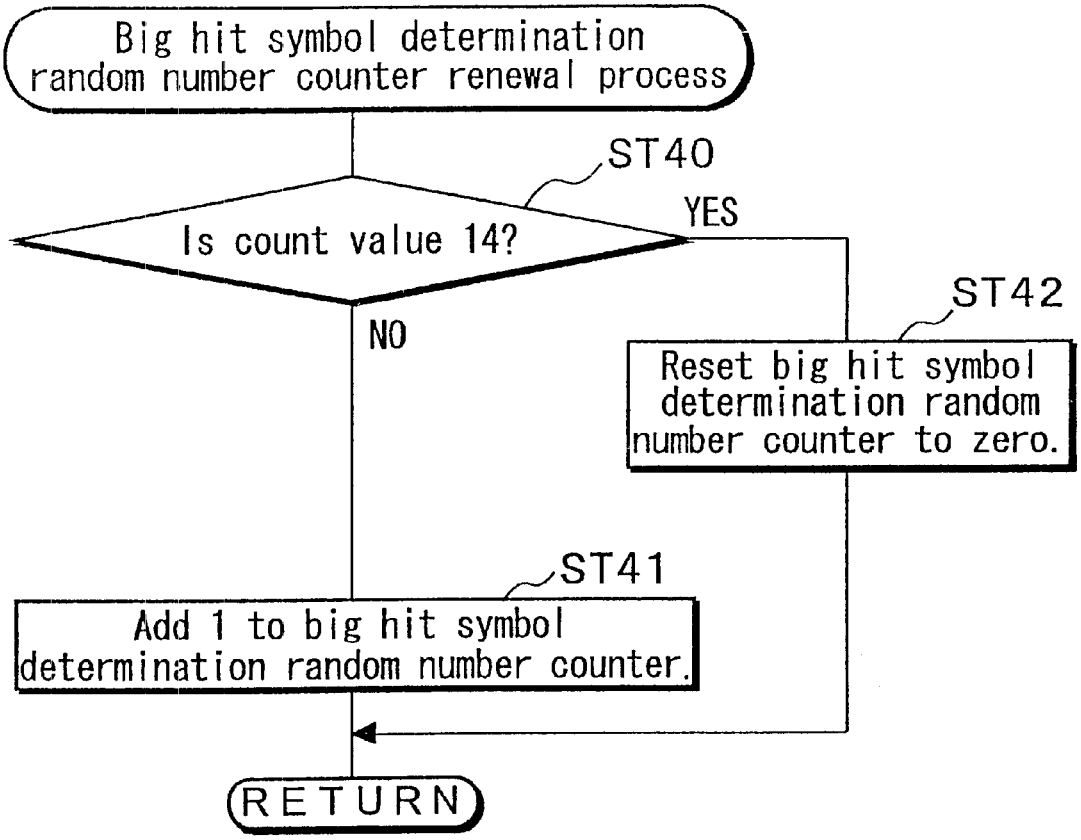
FIG. 13 is a flowchart of a renewal process performed with a random number counter for determining big hit symbols.

The flowchart in FIG. 13 shows the renewal step ST11 in FIG. 4 performed with the big hit symbol determination random number counter 38.

In this renewal step, the addition of +1 is performed every time within the range of "0 to 14" shown in FIG. 16. Therefore, first it is determined if the previously renewed count value is 14 (ST40). If the count value is not 14, it is renewed by adding +1 (ST41). On the other hand, if the previously renewed value is 14, it is reset to zero (ST42).

Figure 14:
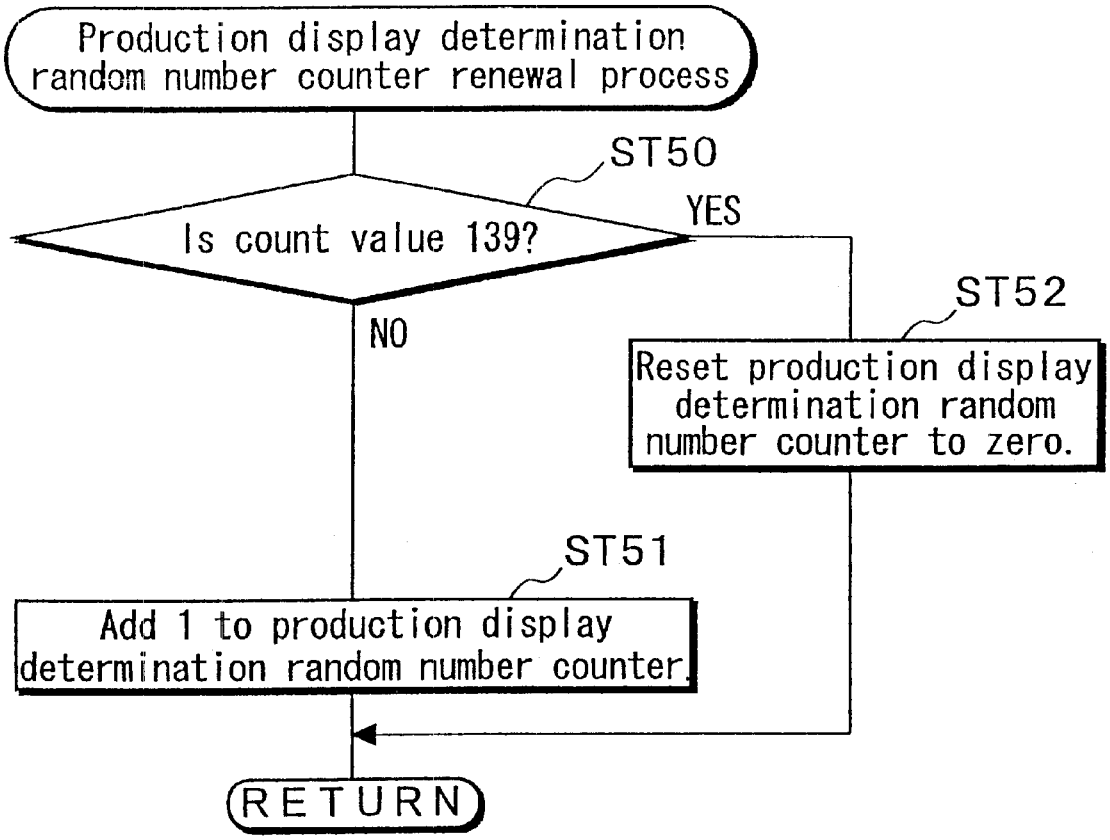
FIG. 14 is a flowchart of a renewal process performed with a random number counter for determining a production display.

The flowchart in FIG. 14 shows the renewal step ST12 in FIG. 4 performed with the production display determination random number counter 39.

In this renewal step, the addition of +1 is performed every time of play within the range of "0 to 139" shown in FIG. 16. Therefore, first it is determined if the previously renewed count value is 139 (ST50). If the count value is not 139, it is renewed by adding +1 (ST51). On the other hand, if the previously renewed value is 139, it is reset to zero (ST52).

Figure 15:
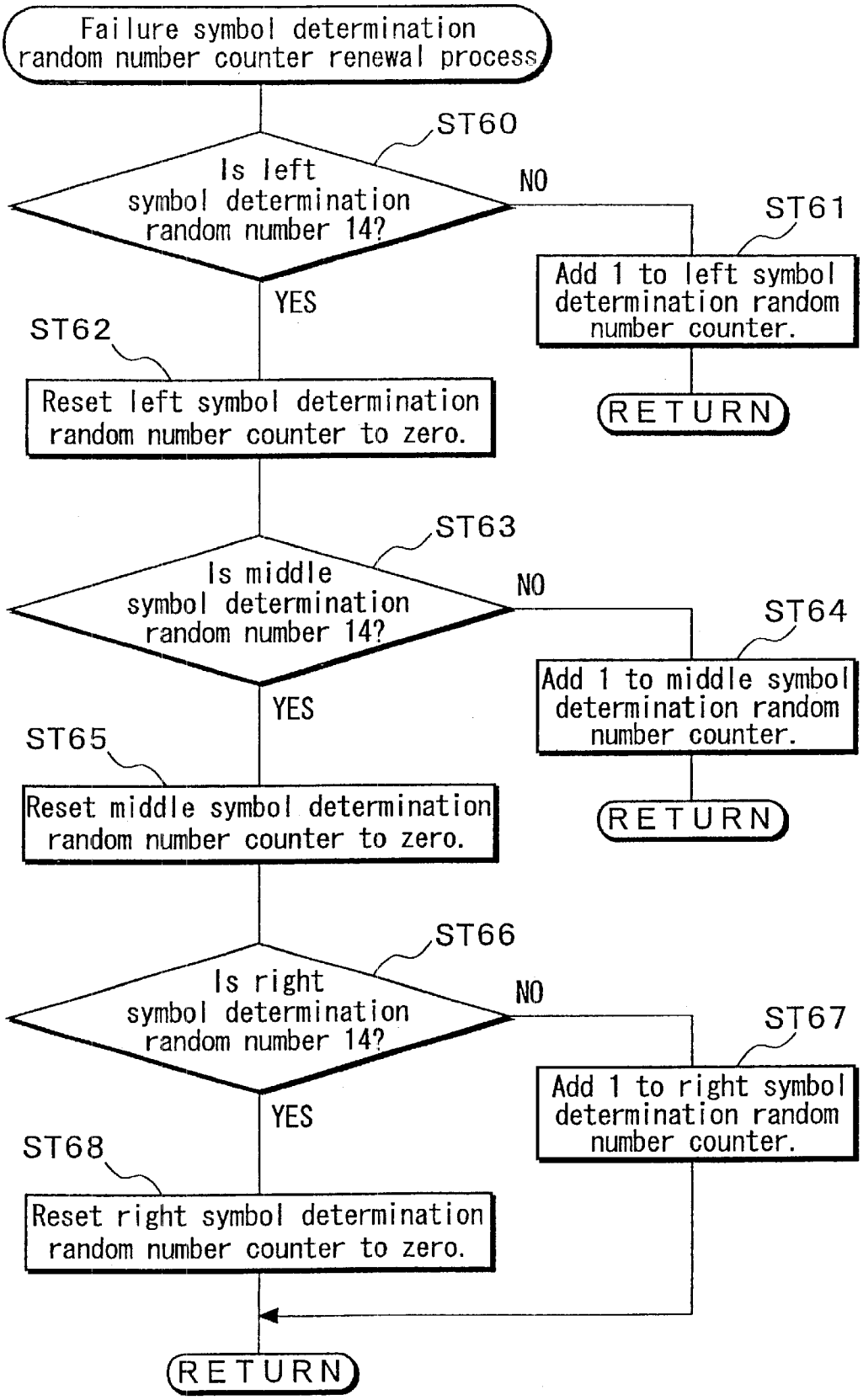
FIG. 15 is a flowchart of a renewal process performed with a random number-counter for determining a failure symbol.

The flowchart in FIG. 15 shows the renewal process performed as the step ST13 in FIG. 4 with the symbol determination random number counter 37.

This renewal process is performed by adding +1 to the count value within the range of "0 to 14" shown in FIG. 16 for each of the three counters provided in the failure symbol determining counter 37; the left symbol determination random number counter 37L, the middle symbol determination random number counter 37C, and the right symbol determination random number counter 37R. Here, the three counters perform the renewal step of adding +1 at different periods.

The left symbol determination random number counter 37L performs the renewal step of adding +1 at every occurrence of interruption, the middle symbol determination random number counter 37C performs the renewal step of adding +1 when the left symbol determination random number counter 37L is reset to zero, and the right symbol determination random number counter 37R performs the renewal step of adding +1 when the middle symbol determination random number counter 37C is reset to zero. Therefore, the sequence of steps becomes as described below.

First, if the count value previously renewed with the left symbol determination random number counter 37L is not 14 ("NO" in ST60), the count value is renewed to a value obtained by adding +1 to the count value (ST61), and the renewal step with the failure symbol determination random number counter 37 is ended.

On the other hand, if the count value previously renewed with the left symbol determination random number counter 37L is 14 ("YES" in ST60), the count value is reset to zero (ST62). Next, if the count value renewed with the middle symbol determination random number counter 37C is not 14 ("NO" in ST63), the count value is renewed with a value obtained by adding +1 to the count value (ST64), and the renewal step with the failure symbol determination random number counter 37 is ended.

If the count value previously renewed with the middle symbol determination random number counter 37C is 14 ("YES" in ST63), the count value is reset to zero (ST65). Next, if the count value previously renewed with the right symbol determination random number counter 37R is not 14 ("NO" in ST66), the count value is renewed with a value obtained by adding +1 to the count value (ST67). If the count value previously renewed with the right symbol determination random number counter 37R is 14 ("YES" in ST66), the count value is reset to zero (ST68) and the renewal step with the failure symbol determination random number counter 37 is ended.

While the above description is made in reference to the pachinko game machine as an example, this invention may be applied to other game machines such as slot machines, etc.

What is claimed is:

1. A game machine comprising:

a display device starting a varying display in response to a startup command, the display device displaying symbols necessary for a game, the symbols including special symbols arranged so that game state shifts to a special game state if the varying display stops at a specified combination of the special symbols;

a controller executing a game control process including controlling the varying display, the controller having a plurality of counters, count values of which are obtained from repeated additions of respective fixed numbers at respective specified counting time intervals and are initialized at respective constant periods, wherein a value calculated using the count values of two of the plurality of counters, the respective constant periods of the two counters being different from each other, is extracted as a random number for a determination, when the startup command is issued, as to whether the game state is to be shifted to the special game state based on the random number.

2. The game machine as recited in claim 1, wherein the value calculated using the count values of the two counters is a sum of the count values of the two counters.

3. The game machine as recited in claim 2, wherein one of the two counters is a register for executing rewriting at rewriting time intervals.

4. The game machine as recited in claim 2, wherein the controller executes a game control process every time an interruption signal is generated at interrupting time intervals, and one of the two counters repeats the addition of the fixed number at the counting time intervals to obtain the count value which is initialized at the constant periods, after the execution of the game control process and until a next interruption signal is generated.

5. A method of playing a game comprising:

starting a varying display in response to a startup command;

displaying symbols necessary for a game, the symbols including special symbols arranged so that game state shifts to a special game state if the varying display stops at a specified combination of the special symbols; and executing a game control process including control of the varying display, the game control process including:

repeating a first addition of a first fixed number at first counting time intervals to obtain a first count value and storing the first count value, initializing the first count value at first constant periods, repeating a second addition of a second fixed number at second specified counting intervals to obtain a second count value and storing the second count value, initializing the second count value at second constant periods different from the first constant periods, extracting a value calculated using the first and second count values as a special determination random number when the startup command is issued, and determining if the game is to be shifted to the special game state based on the special determination random number.

6. The method of playing a game as recited in claim 5, wherein the value calculated using the first and second count values is a sum of the first and second count values.

7. The method of playing a game as recited in claim 6, comprising generating refreshment pulses for executing rewriting actions at refreshing time intervals and repeating at least one of the first and second additions every time a refreshment pulse is generated.

8. The method of playing a game as recited in claim 6, comprising generating interruption signals a at interrupting time intervals, executing the game control process every time an interruption signal is generated, and repeating at least one of the first and second additions at the counting time intervals after executing the game control process and until another interruption signal is generated.

* * * * *